US010570576B1

(12) United States Patent
Mothafar

(10) Patent No.: US 10,570,576 B1
(45) Date of Patent: Feb. 25, 2020

(54) FLEXIBLE GROOVE INLAY

(71) Applicant: Ahmed Younis Mothafar, Safat (KW)

(72) Inventor: Ahmed Younis Mothafar, Safat (KW)

( * ) Notice: Subject to any disclaimer, the term of this patent is extended or adjusted under 35 U.S.C. 154(b) by 0 days.

(21) Appl. No.: 16/521,558

(22) Filed: Jul. 24, 2019

Related U.S. Application Data

(60) Provisional application No. 62/733,266, filed on Sep. 19, 2018.

(51) Int. Cl.
*E01C 23/09* (2006.01)
*E01F 9/529* (2016.01)
*E01C 23/04* (2006.01)

(52) U.S. Cl.
CPC ..... *E01F 9/529* (2016.02); *E01C 23/04* (2013.01)

(58) Field of Classification Search
CPC ..... E01C 23/09; E01C 23/02; E01C 23/021; E01C 23/028; E01C 19/43; E01C 23/04; E01F 9/529
USPC ..... 404/89; 83/875; D8/45
See application file for complete search history.

(56) References Cited

U.S. PATENT DOCUMENTS 993,086 A * 5/1911 Malloy ..... E01C 19/236 404/124
1,744,272 A * 1/1930 La Plant ..... E01C 19/236 404/124
1,916,887 A * 7/1933 McClain ..... E01C 23/025 404/93
3,516,339 A * 6/1970 Perkins ..... E01C 19/43 404/75
3,585,761 A * 6/1971 Hughes ..... B27B 5/34 451/544
3,595,143 A * 7/1971 Polselli ..... E01C 19/43 404/93
3,612,611 A * 10/1971 Ellis ..... B27B 5/34 299/39.4
3,801,211 A * 4/1974 Perkins ..... E01C 11/24 404/75
4,036,126 A * 7/1977 Gundersen ..... A01G 9/081 100/210
4,070,128 A * 1/1978 Garrison ..... E01C 19/43 15/144.4
4,743,140 A * 5/1988 Maletic ..... E01C 19/43 404/89

(Continued)

FOREIGN PATENT DOCUMENTS

CN 201557676 U 5/2010
CN 205474918 U 8/2016
CN 205741964 U 11/2016

*Primary Examiner* — Thomas B Will
*Assistant Examiner* — Katherine J Chu
(74) *Attorney, Agent, or Firm* — Richard C. Litman; Nath, Goldberg & Meyer

(57) ABSTRACT

The low maintenance speed bump is an elongated, rigid, solid body having an arcuate top surface and a flat base, angled grooves defined in the top surface, and a reflective material disposed within the grooves. The reflective material is disposed lower than the top surface of the speed bump to prevent contact between vehicles passing over the speed bump and the reflective material. In this manner, the reflective material is protected from damage by vehicle tires and the life of the reflective material is extended. Further, the angled grooves provide greater visibility of the reflective material to drivers approaching the speed bump.

9 Claims, 8 Drawing Sheets

(56) References Cited

U.S. PATENT DOCUMENTS

| | | | | | |
|---|---|---|---|---|---|
| 4,776,723 | A * | 10/1988 | Brimo | E01C 19/44 | 404/89 |
| 5,022,783 | A * | 6/1991 | Jones | E01C 19/238 | 404/122 |
| 5,033,906 | A * | 7/1991 | Jordan | B44B 5/0009 | 404/124 |
| 5,073,062 | A * | 12/1991 | Leone | B28B 11/0863 | 404/75 |
| 5,083,839 | A * | 1/1992 | Younger | B23D 47/005 | 299/101 |
| 5,249,886 | A * | 10/1993 | Huerta, Jr. | E01C 23/025 | 15/144.1 |
| 5,846,176 | A * | 12/1998 | Zieger | B05C 17/02 | 492/13 |
| 5,896,929 | A * | 4/1999 | Dori | G09F 19/22 | 172/1 |
| 7,140,804 | B2 * | 11/2006 | Gregg | E01C 19/43 | 404/93 |
| 7,469,722 | B2 * | 12/2008 | Berland | H01R 13/562 | 138/110 |
| 8,056,549 | B1 * | 11/2011 | Fleetwood | E01C 23/088 | 125/13.01 |
| 8,100,182 | B2 * | 1/2012 | Smith | E21B 43/013 | 166/339 |
| 8,672,580 | B1 * | 3/2014 | Garceau | E01C 19/508 | 404/75 |
| 2014/0086683 | A1 * | 3/2014 | Bockes | E01C 23/0933 | 404/84.05 |
| 2019/0097256 | A1 * | 3/2019 | Quatannens | H01M 8/2457 | |

* cited by examiner

FLEXIBLE GROOVE INLAY

CROSS-REFERENCE TO RELATED APPLICATION

This application claim claims the benefit of U.S. Provisional Patent Application No. 62/733,266, filed Sep. 19, 2018.

BACKGROUND

1. Field

The disclosure of the present patent application relates to roadway and speed bump reflector design, and particularly to a low maintenance speed bump having reflective markers disposed within angled grooves, as well as a method and device for making the speed bump.

2. Description of the Related Art

Speed bumps, as known in the art, are typically raised structures extending across a portion of a roadway. The bumps define an abrupt change in road elevation to keep vehicle speeds low. These types of elevation changes in the road may also be defined longitudinally along a roadway, raising the traffic level to the level of the sidewalk for a certain distance, and then lowered back to the usual traffic level. Such bump and ramp structures are optical speed limiters, or structures which are visible to drivers from a distance and allow drivers an opportunity to slow down prior to reaching the structure.

Speed bump structures can also be used at various points of possible conflict between motorized traffic and pedestrians, for example, in areas near schools, churches, hospitals, pedestrian crossings, and bicycle paths. It is also possible to integrate bicycle paths and pedestrian crossings into raised speed bumps to improve the safety of persons at crossings and junction areas, which are subject to accidents. Examples are entrances to residential areas, pedestrian crossings, and the like. These structures can also be used around construction sites, as traffic islands, and as dividers for separating or narrowing traffic lanes by extending longitudinally with the direction of traffic.

Conventional speed bumps require frequent maintenance, as the reflectors or markers of conventional speed bumps quickly deteriorate. When the reflectors or markers deteriorate, drivers cannot see the bump soon enough to slow down before reaching the bump. When drivers approach the bump at full speed, stability of the vehicle is impaired, and damage to the vehicle can result, e.g., front end components may be damaged or parts of the exhaust system may be torn off.

Markers on roadways similarly require frequent maintenance due to deterioration from their constant interaction with the tires of vehicles driving overtop. Deterioration of the markers can result in vehicle operators, which may be a human or a computer, to make errors when the information conveyed by the markers is not properly received.

Thus, a low maintenance speed bump solving the aforementioned problems is desired.

SUMMARY

A low maintenance speed bump includes an elongated, rigid, solid body having an arcuate top surface and a flat base, a plurality of angled grooves defined within the top surface, and a reflective material disposed within the grooves. The reflective material is disposed lower than the top surface of the speed bump to prevent contact between vehicles passing over the speed bump and the reflective material. In this manner, the reflective material is protected from damage by vehicle tires, and the life of the reflective material is extended. Further, the angled grooves provide greater visibility of the reflective material to drivers approaching the speed bump. Accordingly, the low maintenance speed bump for use on roadways provides for added safety while requiring less maintenance.

A flexible inlay may be used for creating the angled grooves in the speed bumps. The flexible inlay includes multiple grooving plates disposed between guide blocks on opposing ends of the inlay. Multiple flexible guide wires extend though the grooving plates and a pair of guide blocks to maintain an aligned relationship between each of the guide blocks and the grooving plates. The size of the flexible inlay may be adjusted by adding or removing grooving plates. Grooves may be created in a speed bump or roadway by inverting the flexible inlay, laying the flexible inlay in a desired position before the final layer of material is laid down, and removing the inlay, thus resulting in a groove where the inlay was placed.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
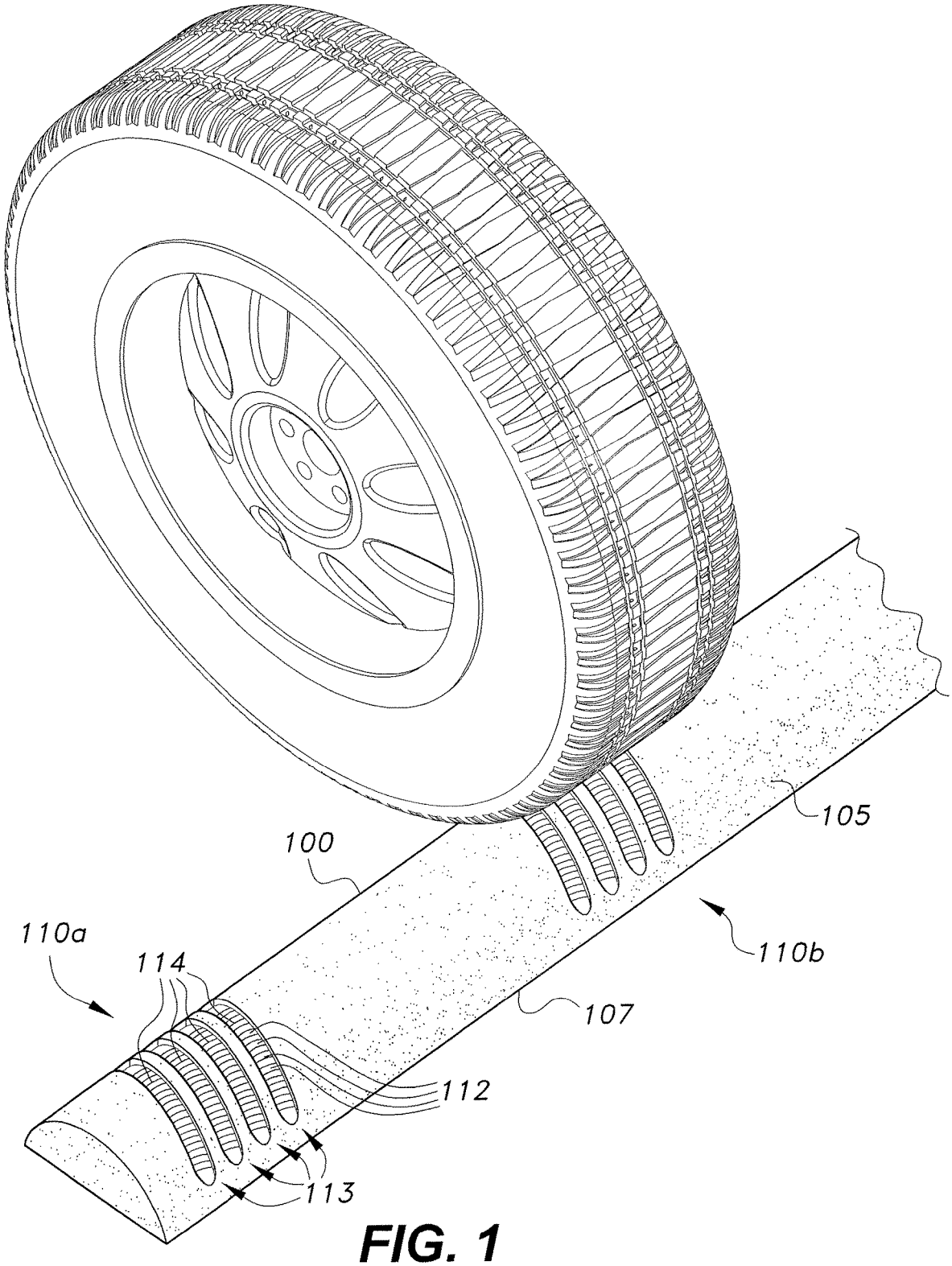
FIG. 1 is a schematic environmental, perspective view of a low maintenance speed bump, shown with a tire crossing a marked section of the speed bump.

FIG. 1 shows a low maintenance speed bump 100 according to the present disclosure. The speed bump 100 includes an elongated, rigid, solid body having a flat base 107 and an arcuate top surface 105. A plurality of angled grooves 112 are defined in the top surface 105 of the rigid body. Each groove 112 is slanted with respect to the top surface. The plurality of grooves 112 is arranged in one or more rows across a portion of the top surface of the body. A reflective material 114 is disposed in each groove 112. The reflective material 114 is disposed lower than the top surface of the speed bump 100. The length of the body of the speed bump 100 is greater than the width of the body. The arcuate top surface 105 defines a constantly changing height of the body extending across the width of the body from one side to the other, i.e., the body defines a bump extending across the roadway for the length of the speed bump 100 that is designed to slow down a vehicle traveling on the roadway as the vehicle crosses the speed bump 100.

Figure 2A:
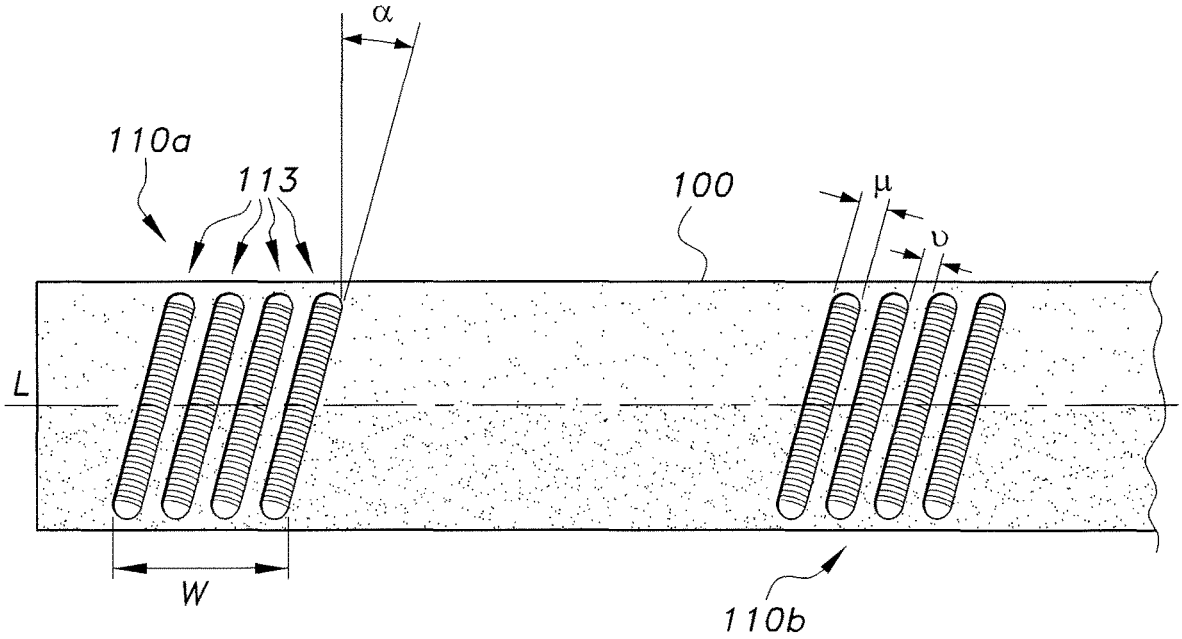
FIG. 2A is a top view of the low maintenance speed bump of FIG. 1A.
Figure 2B:
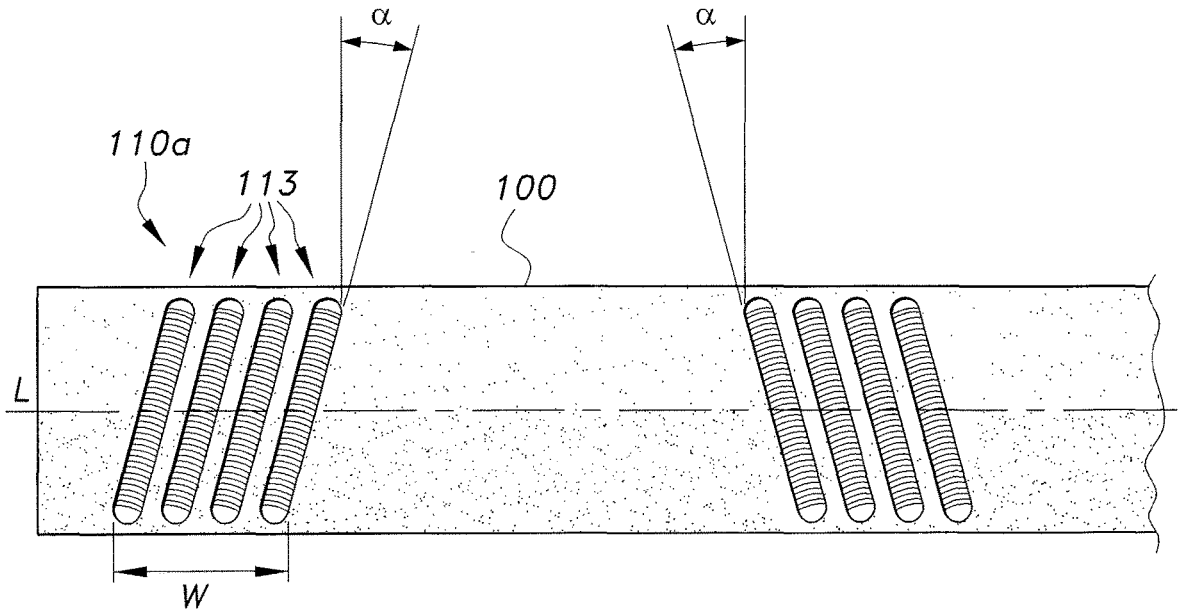
FIG. 2B is a top view of a second embodiment of a low maintenance speed bump.

Preferably, the grooves 112 are arranged in a plurality of rows 113. A plurality of groove rows 113 that are parallel to and equally spaced from each other can form a groove array. Although FIG. 1 shows a first groove array 110*a* and a second groove array 110*b*, it should be understood that a greater number of groove arrays can be provided. Preferably, each groove 112 is configured in the shape of a grooving plate 210 (FIG. 6), with a lower triangular portion and an upper rectangular portion, as described in detail herein. The grooves 112 are slanted at an angle $\alpha$ with respect to an axis normal to a longitudinal axis L of the bump 100, as shown in FIGS. 2A and 2B. The angle $\alpha$ may range from about twenty degrees to about eighty degrees.

As described above, the reflective material 114 is lower than the top surface of the speed bump 100. This prevents contact between the reflective material 114 and vehicles traversing the speed bump 100, and thereby extends the life of the reflective material 114. Accordingly, the speed bump 100 may require less maintenance than conventional speed bumps.

The arrays 110*a*, 110*b* preferably have a width W that is narrower than a width of a vehicle tire. The narrower width W will allow tires to pass over the arrays 110*a*, 110*b* while maintaining contact with the non-grooved portion of the bump 100 on opposing sides of the arrays 110*a*, 110*b*. This will result in a larger contact surface area between the tire and the surface of the bump 100 to produce more friction, and thereby increase control over and safety of the vehicle. The narrow width W of the arrays 110 *a*, 110*b* may also increase longevity of the reflective material 114, as the weight of the car can be largely distributed to areas on the sides of the arrays 110*a*, 110*b*, reducing wear of the reflective material 114.

As described above, the angular offset of the grooves 112 may increase visibility of the reflective material 114. For example, the angular offset a of arrays 110*a*, 110*b* may be in opposite directions, as seen in FIG. 2B. In addition, the slant of grooves 112 with respect an axis normal to the longitudinal axis L of the bump 100 can provide a greater contact surface for the tires. For example, some vehicles, such as motorcycles or mopeds, may not have tires wider than the arrays 110*a*, 110*b* of grooves 112. Angling the arrays 110*a*, 110*b* of grooves 112 provides a greater contact surface for the tires, and minimizes the risk of the tires getting caught in a groove 112.

Although the grooves 112 can have any suitable dimension, the width $\mu$ of the individual grooves 112 may range from about one to three and one-half inches. The spacing between the individual grooves 112 may range from about one quarter to one and one-half inches. The number of groove rows in an array can range from about two to about eight. Width $\omega$ of an array preferably ranges from three to twelve inches. It is also contemplated that the arrays 110*a*, 110*b* be evenly spaced from each other across the entire speed bump 100, with larger spaces in between the arrays 110*a*, 110*b* than between groove rows within each array. The speed bump 100 may include three or more arrays. The embodiments shown in the drawings are exemplary and are not intended to be limiting.

A method of preparing the low maintenance speed bump 100 includes defining grooves 112 within paving material by placing an inverted flexible groove inlay 200 in a partially paved speed bump 100, paving around the flexible groove inlay 200 to create grooves 112 in the paving material, removing the flexible groove inlay 200, and adding reflective material 114 to the grooves 112 created by the inlay 200. Alternatively, the flexible inlay 200 may be pressed into soft paving material to create the grooves 112.

Figure 3:
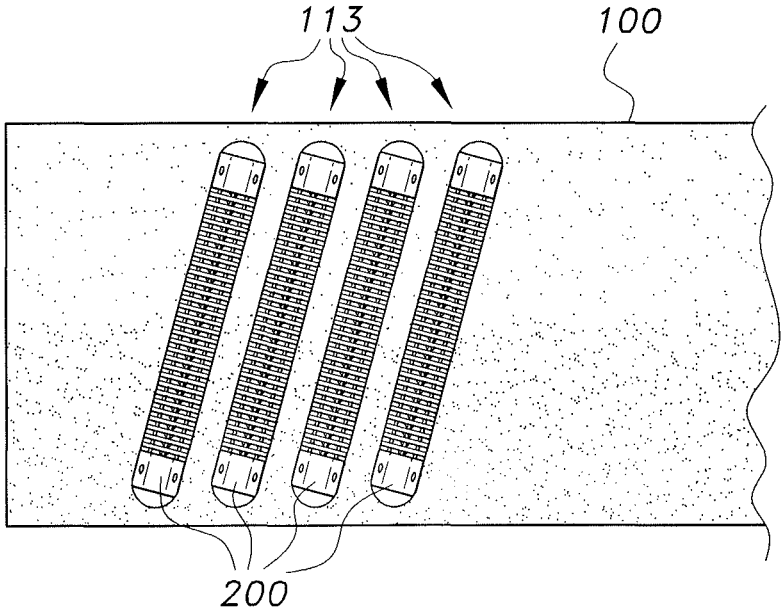
FIG. 3 is a partial environmental top view of a low maintenance speed bump under construction, shown before the flexible groove inlays are removed.

The method may include adding multiple layers of asphalt on top of each other to build up the structure of the speed bump 100. Before laying the last layer, the flexible groove inlay 200 is inverted and placed on the bump 100 to form the grooves 112. As shown in FIGS. 2A and 3, in one configuration, four flexible groove inlays 200 may be positioned parallel to each other with their longitudinal axis angularly offset from an axis normal to the longitudinal axis L of the speed bump 100. Each of the flexible groove inlays 200 may be laid in a straight line, in an arc, or in an "S" shape.

After the flexible groove inlays 200 are placed in their intended positions, the final layer of pavement is laid around the inlays 200. The inlay 200 may be positioned lower than the final pavement layer to allow compacting with the inlay 200 left in place. Alternatively, once the final layer of pavement is laid, the flexible groove inlay 200 can be pressed into the soft pavement before it is compacted or hardened. FIG. 3 shows the speed bump 100 prior to removal of the flexible groove inlays 200.

Once the paving process is complete, the flexible groove inlays 200 are removed from the bump 100 to expose the grooves formed by the grooving plates. Removal can be performed by hand or by a small, portable hoist or crane.

Finally, the reflective material 114 can be placed within the grooves 112 formed by the inlay 200. The reflective material 114 may be in the form of paint or a precut polymer strip, which is applied to the bottom of the groove 112. Depending on the type of reflective material 114 chosen, a clear polymer sealer may be applied on top for added longevity. The reflective material 114, or the combination of reflective material 114 and sealer, may fill up a portion of the groove 112 or the entire groove 112. In the case of the polymer strip, a thermoplastic may be used, which can be heated to an adhesive state and then placed in the groove 112. Any type of reflective material may be used. For example, a retroreflective material (a material that reflects light to the original light source) may be used, for example, 3M Scotchlite™. It is also contemplated that the reflective material 114 may include first portions that are retroflective, second portions that reflect light, and third portions that scatter the light.

Figure 4:
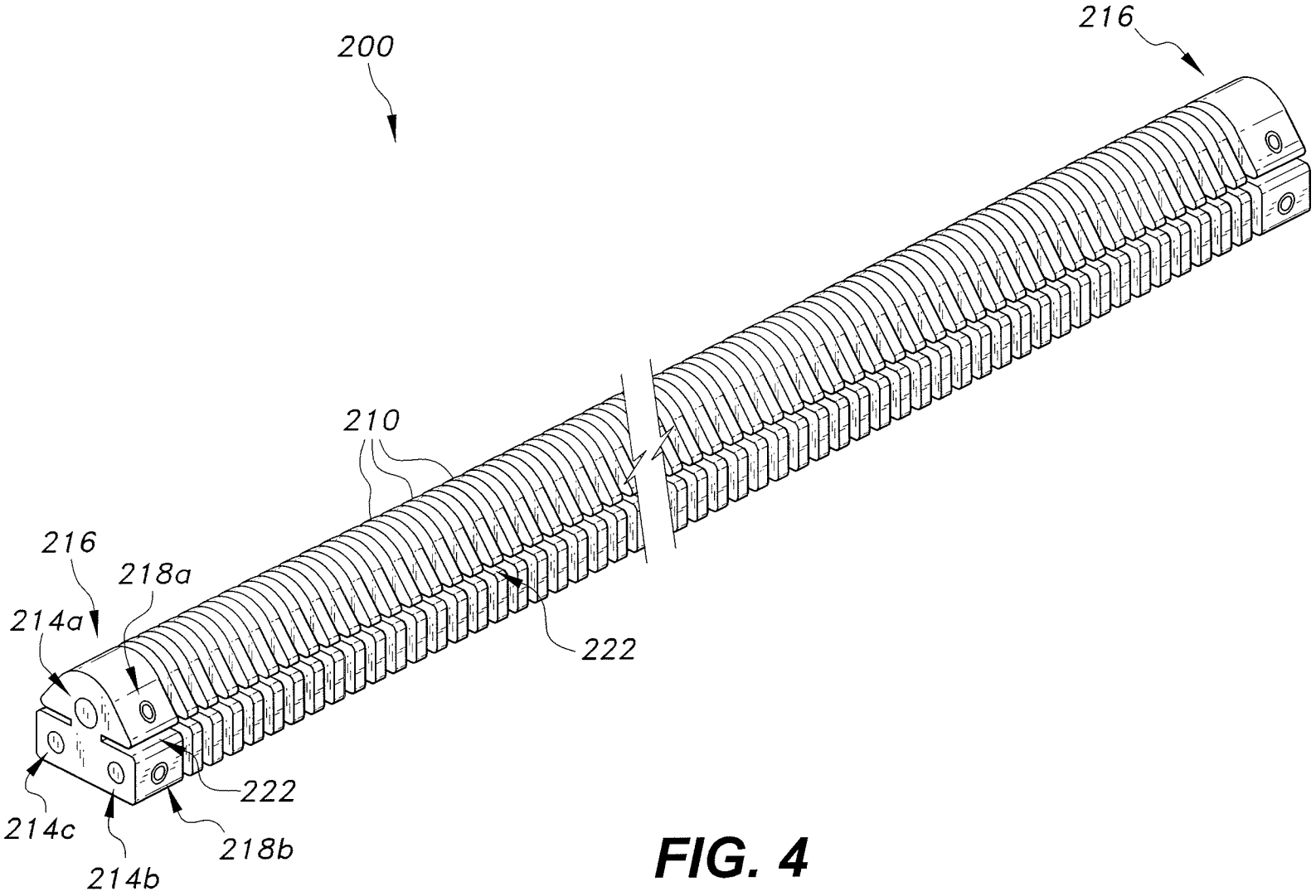
FIG. 4 is a perspective view of the flexible groove inlay.
Figure 5:
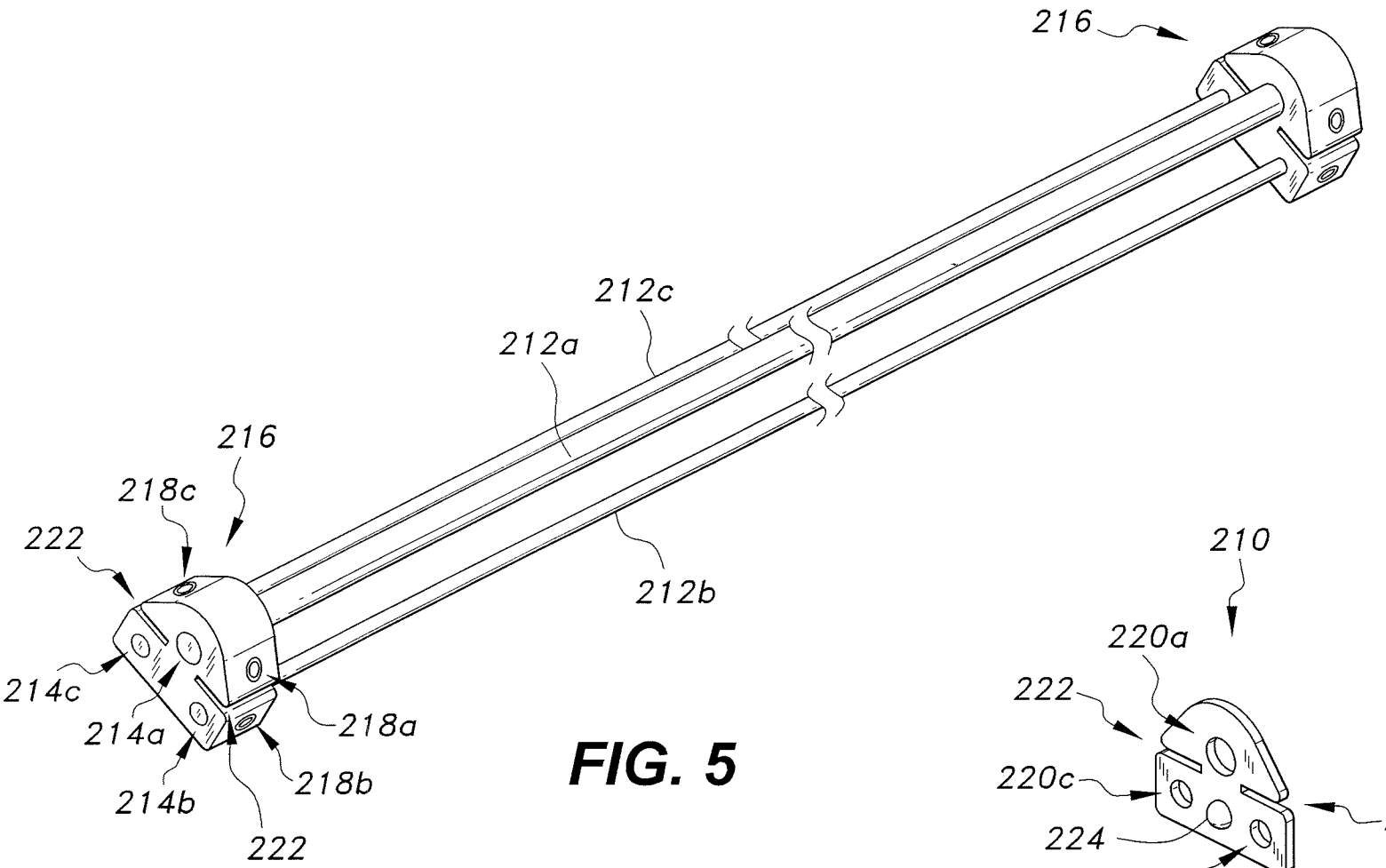
FIG. 5 is a perspective view of the flexible groove inlay of FIG. 4, shown without the grooving plates.

FIGS. 4-5 show an embodiment of the flexible groove inlay 200. The flexible groove inlay 200 includes guide blocks 216 on opposing ends with three guide wires 212*a*, 212*b*, 212*c* and multiple grooving plates 210 extending therebetween. The guide wires 212*a*, 212*b*, and 212*c* each extend through a separate guide hole 214*a*, 214*b*, or 214*c* in the guide blocks 216, and plate holes 220*a*, 220*b*, or 220*c* in grooving plates 210, respectively. Grooving plates 210 can be added or removed to adjust the length of the flexible groove inlay 200.

FIG. 5 shows the flexible groove inlay 200 without any grooving plates 210 attached. The wire 212*a* can have a larger diameter than wires 212*b* and 212*c*. The wire 212*a* provides support so the inlay 200 retains its structure, while the wires 212*b* and 212*c* prevent the grooving plates 210 from twisting out of alignment. Each guide block 216 includes an associated screw 218*a*, 218*b*, and 218*c* for securing the guide wires 212*a*, 212*b*, and 212*c* to the guide blocks 216 at a certain position for setting a length of the inlay 200. Alignment slots 222 are provided on opposing sides of the guide blocks 216.

Figure 6:
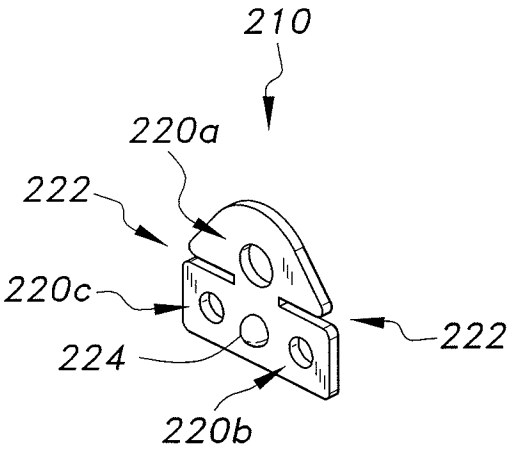
FIG. 6 is a perspective view of a grooving plate.

FIG. 6 shows an individual grooving plate 210. The grooving plate 210 includes an upper triangular portion, a lower rectangular portion, and a narrow neck portion connecting a center of the rectangular portion to a center of the triangular portion. The two slots 222 are defined along opposing sides of the neck portion between the triangular portion and rectangular portion. The slots 222 may be used to align the grooving plates 210 prior to assembly of the inlay 200 and to accept butting keys 201 during use (see FIGS. 8-9). A user can quickly slide the guide wires 212*a*, 212*b*, and 212*c* through a desired number of grooving plates 210 without the need for adjusting each plate 210 to align the holes 220*a*, 220*b*, and 220*c*. The triangular portion of the grooving plate 210 is designed to point downward when in use. Grooving plates 210 and guide blocks 216 can be of various dimensions and configurations, depending on the intended shape of the groove 112. For example, the height of the rectangle can be increased or decreased to change the depth of the groove 112. Additionally, the top of the triangular portion may be "s" shaped to create two particulate retention channels in each groove 112.

A semi-spherical protrusion 224 is located at a center of the grooving plate 210. The semi-spherical protrusion 224 keeps adjacent guide plates uniformly separated so the grooves are equally spaced. Other shapes and locations can be used for the protrusion to promote certain types of bending. For example, a rectangular protrusion would permit lateral bending and resist vertical bending.

The length of the flexible groove inlay 200 may be adjusted by adding or removing grooving plates 210. Decreasing the length of the inlay 200 can be accomplished by loosening the screws 218*a,b,c* on one of the guide blocks 216 and separating the guide block 216 from the guide wires 212. Once the guide block 216 is removed, a desired number of grooving plates 210 can be slid off the guide wires 212*a*, 212*b*, and 212*c*, and the guide wires 212*a*, 212*b*, 212*c* can be re-inserted into their respective guides 214*a*, 214*b*, and 214*c* in the previously removed guide block 216. Once all of the grooving plates 210 and the guide block 216 are slid together, the guide screws 218*a*, 218*b*, 218*c* can be tightened to lock the guide block 216 in place at a new location. Finally, the portions of the guide wires 212*a*, 212*b*, 212*c* extending past the guide block 216 may be cut flush with the guide block 216 to prevent them from interfering during the construction process. Lengthening the inlay 200 requires obtaining longer guide wires 212*a*, 212*b*, 212*c* and assembling the grooving plates 210 using the steps outlined above.

Figure 7:
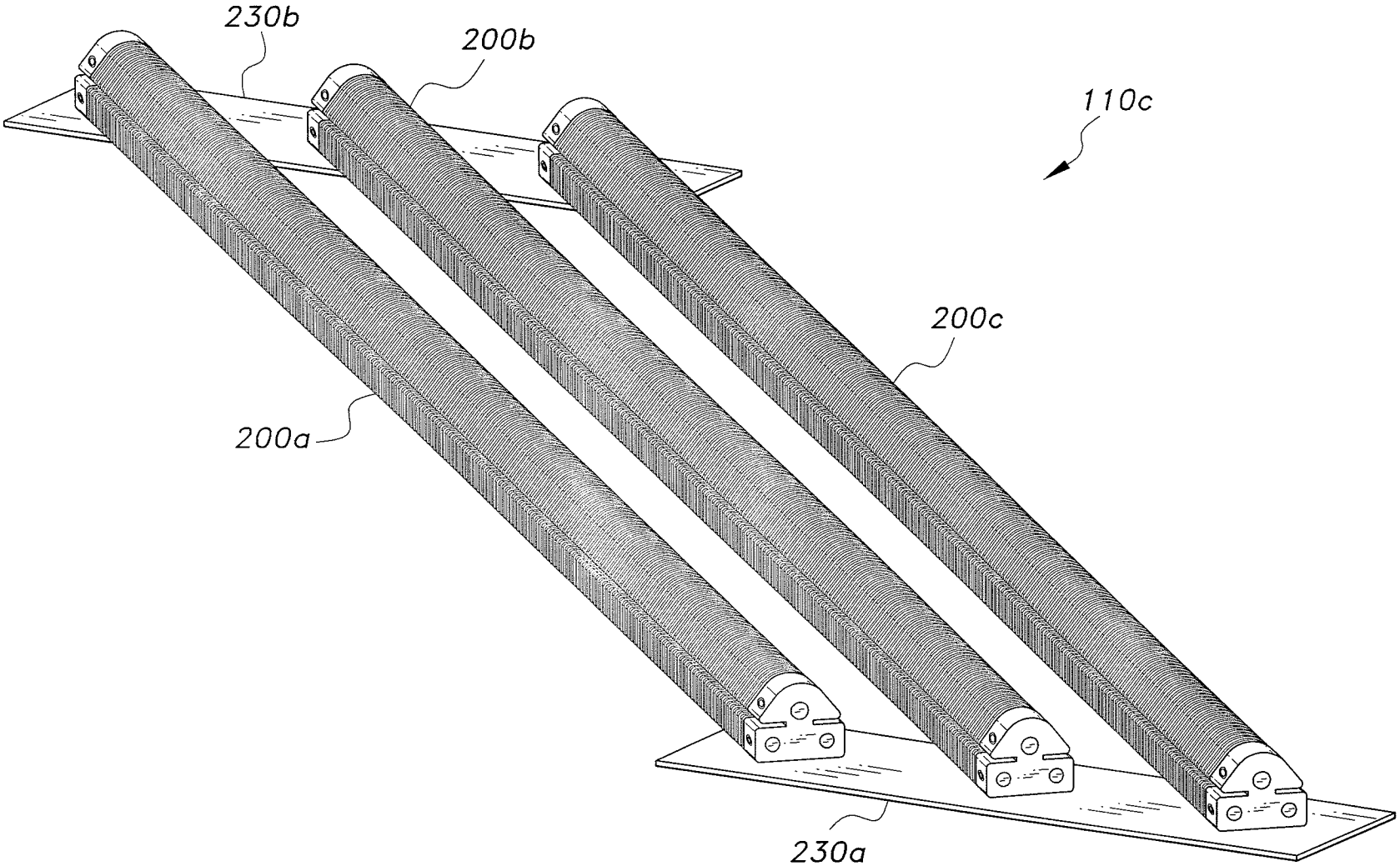
FIG. 7 is a perspective view of an array of flexible groove inlays, shown connected to alignment plates to form spaced grooves.

FIG. 7 shows alignment plates 230 that are aligned in an array of flexible groove inlays 200 in a parallel orientation. One end of each inlay 200*a*, 200*b*, 200*c* in a single array 110*c* is connected to the first alignment plate 230*a*, which evenly spaces them apart. Similarly, the other end of each of the inlays 200*a*, 200*b*, 200*c* is attached to a second alignment plate 230*b* having the same spacing to provide a parallel relation between the inlays 200*a*, 200*b*, 200*c*. Each of the inlays 200 is attached to the plates 230*a*, 230*b* with the triangular portion opposite the plates 230*a*, 230*b*. This allows the plates 230*a*, 230*b* to remain on top of the pavement while the inlays 200*a*, 200*b*, 200*c* create the grooves 112. The inlay 200*a*, 200*b*, 200*c* may be connected to the alignment plates 230*a*, 230*b* by any means known in the art. Exemplary fasteners include bolts, pegs, and rails.

Figure 8:
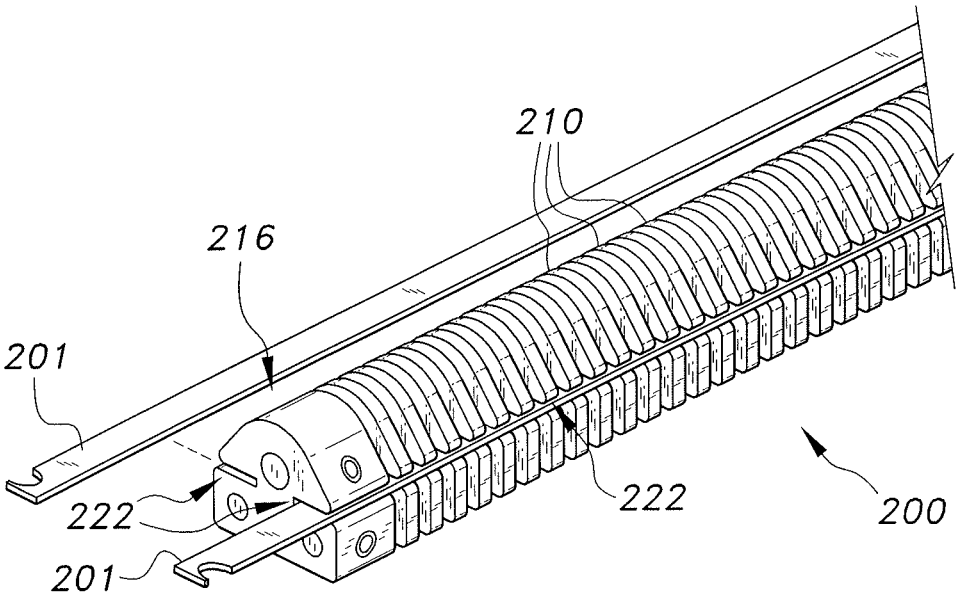
FIG. 8 is a partially exploded perspective view of the flexible groove inlay, shown with a first butting key inserted into one of its slots and a second butting key exploded from the opposing slot.
Figure 9:
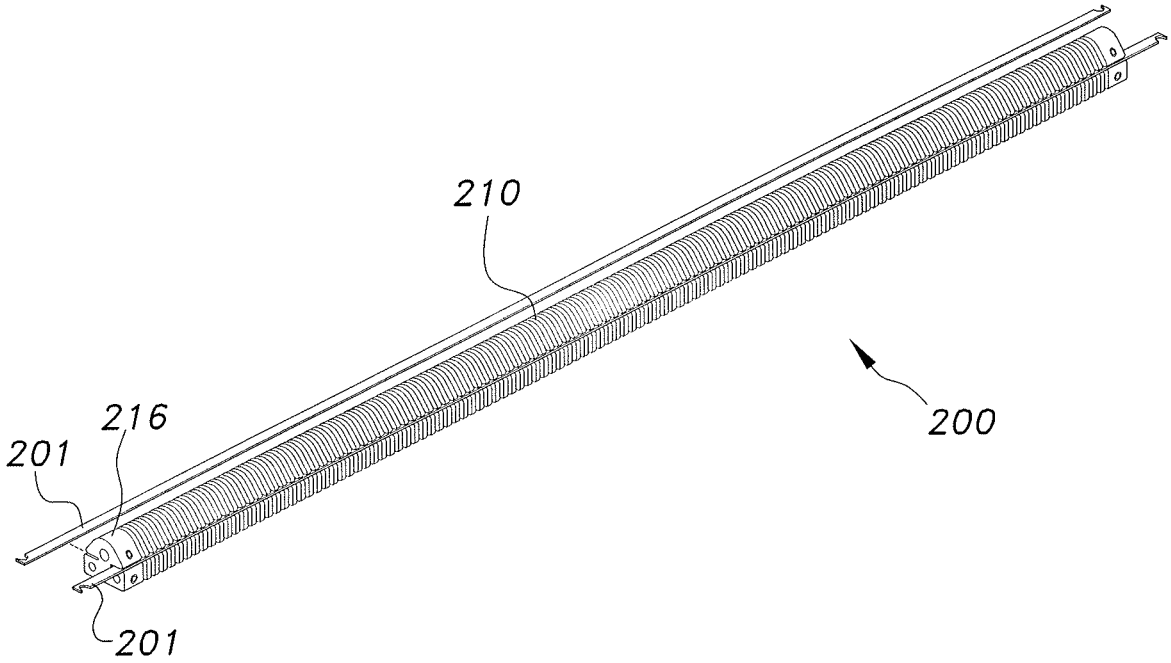
FIG. 9 is an exploded perspective view of the flexible groove inlay with a first butting key inserted into one of its slots and a second butting key exploded from the opposing slot.

FIGS. 8 and 9 show a flexible groove inlay 200 with butting keys 201 inserted in the slots 222 of the grooving plates 210 and guide blocks 216. Inserting butting keys 201 into the slots 222 of the flexible groove inlay 200 will increase the rigidity of the inlay 200. The increased rigidity will help the multi-piece inlay 200 act as a single piece under the pressing and compacting process. Accordingly, when the inlay 200 is laid with a high degree of curvature, it will be less likely to lose its shape under compacting when the butting keys 201 are within the slots 222. The butting keys 201 may have indentations at their end to assist in inserting into and removing from the slots 222 of the inlay 200.

Figure 10:
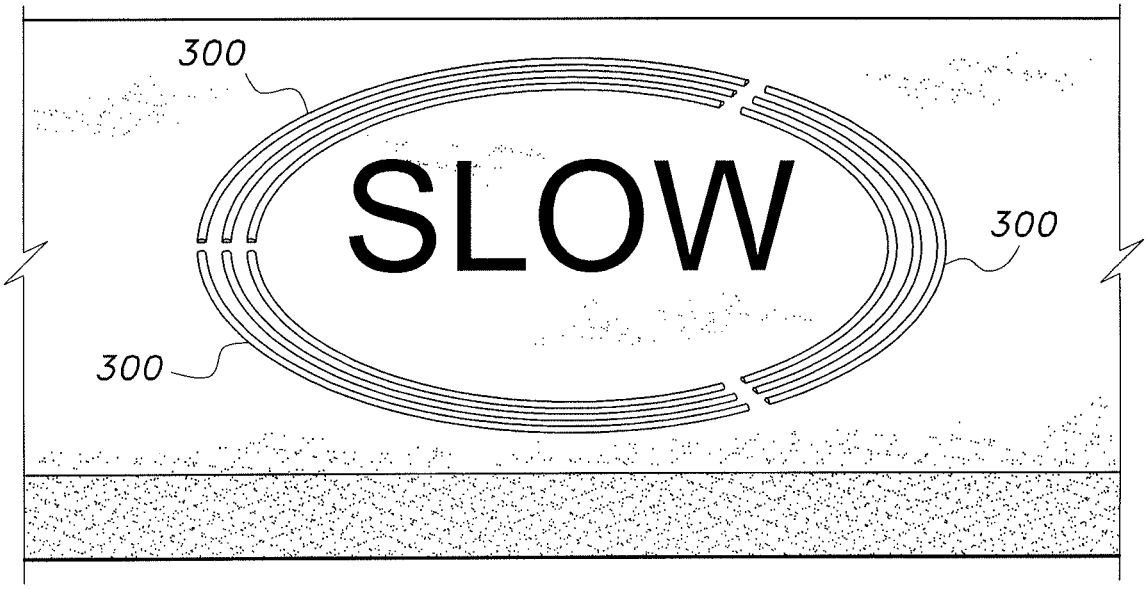
FIG. 10 is a perspective view of a roadway marker surrounded by grooves created using flexible groove inlays.

In some cases, the flexible groove inlays 200 may be used to surround and draw attention to a marking in the road. FIG. 10 shows a roadway with the descriptive marking "SLOW" painted thereon. Since a user may have difficulty noticing only the descriptive making, the descriptive making can be surrounded by reflective grooves 300 formed using the flexible groove inlay 200. As seen in FIG. 10, the grooves 300 may be highly arcuate. In some cases it may be beneficial to create these types of grooves 300 with flexible groove inlays 200 having butting keys 201 inserted to maintain a consistent shape throughout the inlay 200.

The guide wires 212*a*, 212*b*, 212*c* may be made out of a flexible material, allowing the inlay 200 to conform to the shape of the speed bump 100 and/or create arcuate grooves. —Examples of flexible materials include polyethylene and polypropylene. The guide blocks 216 and grooving plates 210 may be made out of rigid material. Examples include steel and aluminum.

To ensure easy and clean removal of the flexible groove inlay 200 from the bump 100, a flexible sleeve may be disposed around the inlay 200 prior to the groove forming process. The sleeve can be a flexible, high endurance, abrasion resistance material, such as Kevlar® Cut-Tex® PRO.

The flexible groove inlays 200 may be used to create roadway grooves 300 in areas other than speed bumps 100, as seen in FIG. 10. For example, visible, low maintenance markings can be made in flat pavement to provide drivers with guidance or warning. The forming process is similar to the method discussed above, with the difference being that the flexible groove inlays 200 are laid on a portion of a road or parking lot that is not a speed bump. Alternatively, the flexible groove inlays 200 can be used to create drainage grooves in asphalt by skipping the step of adding the reflective material.

For example, roads may be designed to provide information to self-driving cars. This information may be critical to the stability of the auto-pilot and the safety of the passenger. Accordingly, it may not be acceptable to create in-road marks that can fade over time. The presently disclosed flexible groove inlay 200 may be used to create markings in the roadways that will not fade over time.

The marking may be used as lane dividers and guides, as well as to provide driving information, such as speed limit. For example, the speed limit may be coded into the road using different length lines that can be translated into numbers by the vehicle. The shortest line may indicate a zero, and the line may incrementally increase in size until the line length indicates a nine. The lines should be sharp and not subject to wear so they can be properly interpreted by the auto-pilot. By using a flexible groove inlay 200 to create a groove in the roadway, and then filling that groove with a thermoplastic or similar material, indicators will be produced that will not vary in size due to wear and will provide consistently accurate information to auto-pilots and human drivers of cars.

It is contemplated that the flexible groove inlay 200 may be used to create grooves in concrete. Once the concrete is distributed and screened or flattened, the inlay 200 can be pressed into the concrete. After pressing in the inlay 200, a final flattening may be performed. Once the concrete has partially cured, the inlays 200 can be removed leaving grooves in the concrete.

It is to be understood that the low maintenance speed bump is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A flexible groove inlay, comprising:

first and second guide blocks, each guide block having three apertures defined therein;

three elongated guide wires, each of the guide wires having a first end and a second end, the first end of each of the guide wires extending through a respective one of the apertures in the first guide block, the second end of each of the guide wires extending through a respective one of the apertures of the second guide block; and a plurality of grooving plates, each of the grooving plates having three apertures defined therein, the grooving plates being mounted on the guide wires between the first and second guide blocks, wherein the guide blocks and the grooving plates each have a lower rectangular portion, an upper triangular portion, and a neck portion connecting the lower rectangular and upper triangular portions, the neck portion defining opposing slots between the upper triangular portion and the lower rectangular portion on each side of the neck portion.

2. The flexible groove inlay according to claim 1, wherein said grooving plates are uniformly spaced on said guide wires.

3. The flexible groove inlay of claim 1, the three apertures defined in said guide blocks and the three apertures defined in said grooving plates each include a first aperture defined in the triangular portion of each said guide block and each said grooving plate, the first apertures being aligned, and second and third apertures defined in the rectangular portion of each said guide block and said grooving plate, the second apertures being aligned and the third apertures being aligned.

4. The flexible groove inlay of claim 3, wherein the first aperture has a larger diameter than the second and third apertures, the guide wire extending through the first apertures having a larger diameter than the guide wires extending though the second and third apertures.

5. The flexible groove inlay of claim 1, further comprising first and second alignment wires extending through the opposing slots on opposite sides of the neck portion of the guide blocks and grooving plates.

6. The flexible groove inlay of claim 5, further comprising two butting keys, the butting keys being elongate strips inserted into the opposing slots on opposite sides of the neck portion of the guide blocks and grooving plates, each of the butting keys having at least equal to the guide wires.

7. The flexible groove inlay of claim 1, wherein each said guide block includes a retaining screw for each of the apertures, each of the retaining screws selectively retaining the corresponding guide wire fixed to said guide block.

8. The flexible groove inlay of claim 1, wherein each said grooving plate further comprises a rounded projection disposed on the plate for maintaining uniform spacing between said grooving plates.

9. An array of flexible groove inlays, comprising:

a plurality of the flexible groove inlays of claim 1; the first guide block of each of the inlays defining a first end of the inlay and the second guide block of each of the inlays defining a second end of the inlay;

a first alignment plate, the first end of each of the inlays being attached to the first alignment plate; and a second alignment plate, the second end of each of the inlays being attached the second alignment plate, the first and second alignment plates maintaining the plurality of flexible groove inlays in parallel and spaced relation.

* * * * *